US005813337A

United States Patent [19]

Peters et al.

[11] Patent Number: 5,813,337

[45] Date of Patent: Sep. 29, 1998

[54] CLOSED-LOOP PRINTING CONTROL SYSTEM

[75] Inventors: Lawrence R. Peters, Brookfield; Keith A. Tabor, Richfield; Michael J. Horvath, Germantown; Mark Hackler, Pewaukee; Robert Knier, Muskego, all of Wis.

[73] Assignee: Quad/Tech, Inc., Sussex, Wis.

[21] Appl. No.: 658,279

[22] Filed: Jun. 5, 1996

[51] Int. Cl.[6] ..... B41F 13/54

[52] U.S. Cl. ..... 101/228; 101/226; 226/18; 226/20

[58] Field of Search ..... 101/219, 228, 101/232, 226; 400/630, 579; 226/2, 3, 15, 18, 19, 20

[56] References Cited

U.S. PATENT DOCUMENTS

| | | | |
|---|---|---|---|
| 2,961,548 | 11/1960 | Prell | 250/219 |
| 3,567,091 | 3/1971 | Woolard | 226/18 |
| 3,682,362 | 8/1972 | Ott, Jr. | 226/21 |
| 3,752,377 | 8/1973 | Knapp | 226/3 |
| 4,135,664 | 1/1979 | Resh | 235/475 |
| 4,243,925 | 1/1981 | Gnuechtel | 318/603 |
| 4,366,753 | 1/1983 | Glanz et al. | 101/181 |
| 4,385,716 | 5/1983 | De Roeck et al. | 226/20 |
| 4,470,555 | 9/1984 | Lawson | 242/56.2 |
| 4,527,069 | 7/1985 | Pfizenmaier | 250/548 |
| 4,606,486 | 8/1986 | Brunner et al. | 226/19 |
| 4,848,632 | 7/1989 | Mack et al. | 226/18 |
| 4,887,530 | 12/1989 | Sainio | 101/181 |
| 4,896,807 | 1/1990 | Mundschau | 226/21 |
| 4,913,049 | 4/1990 | Sainio | 101/211 |
| 4,960,234 | 10/1990 | Focke | 226/15 |
| 4,991,761 | 2/1991 | Gnuechtel et al. | 226/15 |
| 5,117,610 | 6/1992 | Hartman et al. | 53/411 |
| 5,119,725 | 6/1992 | Okamura | 101/226 |
| 5,129,568 | 7/1992 | Fokos et al. | 226/27 |
| 5,176,371 | 1/1993 | Rau et al. | 270/42 |
| 5,224,640 | 7/1993 | Fokos et al. | 226/2 |
| 5,289,770 | 3/1994 | Hern | 101/226 |
| 5,361,960 | 11/1994 | Fokos et al. | 226/2 |
| 5,412,577 | 5/1995 | Sainio et al. | 364/469 |
| 5,415,092 | 5/1995 | Hern | 101/226 |
| 5,540,146 | 7/1996 | Lapp | 101/228 |

FOREIGN PATENT DOCUMENTS

| | | |
|---|---|---|
| 0 018 223 A1 | 10/1980 | European Pat. Off. . |
| WO 85/04643 | 10/1985 | WIPO . |

*Primary Examiner*—Ren Yan
*Attorney, Agent, or Firm*—Michael, Best & Friedrich

[57] ABSTRACT

A system for controlling the lateral position of a web in a web-fed printing press having a printing unit. The web has a series of printed images thereon. The system includes an optical scanner for sensing the lateral position of an image on the web and for generating a first signal. The system also includes an edge sensor which senses the lateral position of a corresponding web edge and which generates a second signal. A controller processes the first and second signals to produce a control signal. The systems also includes a positioning means responsive to the control signal for laterally positioning the web.

21 Claims, 5 Drawing Sheets

CLOSED-LOOP PRINTING CONTROL SYSTEM

BACKGROUND OF THE INVENTION

The invention relates generally to a web-fed printing control system. More particularly, the invention relates to a closed-loop control system for laterally aligning a web with various printing system devices such that alignment occurs relative to the actual position of ink on the web.

In a typical multicolor web-fed printing system, a web of material (e.g. paper) is sequentially driven through a plurality of printing units. Each printing unit applies a different color ink to the web to produce a multicolor image. An infeed web guide located upstream of the printing units controls the lateral position of the web fed to the printing units thereby controlling the expected placement of ink on the web.

A color registration unit is employed to maintain registration (alignment) between respective ink colors. More particularly, an optical scanning device is utilized in conjunction with register marks printed on the web in order to determine the placement of each ink color relative to a reference ink color. Error signals are produced to effect position correction of the respective printing unit plates as necessary to achieve proper registration between ink colors. Such a color registration system is described in U.S. Pat. No. 4,887,530, issued to the assignee of the present invention.

The web is typically routed through a thermal dryer which dries the ink and then to a series of chill rolls which operate to cool the web and set the ink. A web guide is placed before a coating unit which applies silicone to the web. Subsequently, a slitter slits the web longitudinally (in a direction parallel to the direction of web movement) into two ribbons. Thereafter, the ribbons are aligned one on top of the other, and directed to a folder which operates to longitudinally fold the ribbons. A cutting unit controlled by a cutoff control system operates to cut the folded ribbons in a direction transverse to the direction of web movement at the appropriate time. An appropriate cutoff control system is described in U.S. Pat. Nos. 4,736,446, 4,882,764 and 4,885,785; all of which are assigned to the assignee of the present invention.

As described so far, the printing system outputs a number of "signatures" each consisting of eight pages. The signatures are subsequently processed off-line into magazines or the like.

In the typical printing system, the slitter operates to slit the web at a given lateral position, typically at the center of the web. The infeed web guide operates to laterally position the web fed to the printing units such that the image is printed on the web at a desired location; for example, it may be desirable to center the image on the web. A chill web guide located in front of the slitter operates to position the web with respect to the slitter using the edge of the web as a reference. The slitting process thus occurs relative to the edge of the web, or indirectly relative to the expected position of ink on the web.

Similarly, the folder operates to fold the ribbons at a predetermined lateral position relative to the expected position of ink on the ribbons. Typically, the desired fold location is not the center of the ribbon because it is often desired that one ribbon edge overlap the other in order to facilitate signature handling during subsequent off-line finishing processes.

SUMMARY OF THE INVENTION

Typically, a printing system as described above operates with web speeds of approximately 1600 feet per minute or greater. At these high speeds, the web may undergo lateral shifts at various points in the printing system. Lateral shifts of the web occurring between the infeed web guide and the printing units cause the actual lateral position of the ink on the web (as measured with respect to a web edge) to vary from its expected position. Because the slitter and the folder in such a system operate relative to the expected position of ink on the web, when the actual lateral position of ink differs significantly from its expected position, the slit and fold locations are not in the right place with respect to the image location. For example, in the final printed product, images on adjacent pages are misaligned and the dimensions of margins around the images are not consistent.

The present invention improves output quality of the printed product by operating the printing system such that the web is slit relative to the actual position of ink on the web. Similarly, the ribbons are folded relative to the actual position of ink on the ribbons.

In one embodiment of the present invention, the optical scanner of the color registration system determines the lateral position of ink on the web on an on-going basis. That is, the lateral position of the ink is periodically sampled at different points as the web passes by the scanner. Concurrently, an edge sensor monitors the lateral position of the edge of the web corresponding to each sampled lateral ink position. Thus, the actual lateral position of the ink with respect to a web edge is monitored on an on-going basis. A dimension indicative of offset between the actual and expected edge-to-ink position is determined for each sampled point. This dimension is fed to various web positioning control units downstream such that lateral alignment of the web with the slitter and with the folder is maintained relative to the actual position of ink on the web. Additionally, this dimension is fed upstream to the infeed web guide in order to effect more accurate infeed web guiding.

It is a principal advantage of the present invention to provide a closed loop printing control system which improves quality of the printed product while minimizing paper waste due to lateral shifting of the web.

Other features and advantages of the invention will become apparent to those of ordinary skill in the art upon review of the following detailed description, claims, and drawings.

Figure 1:
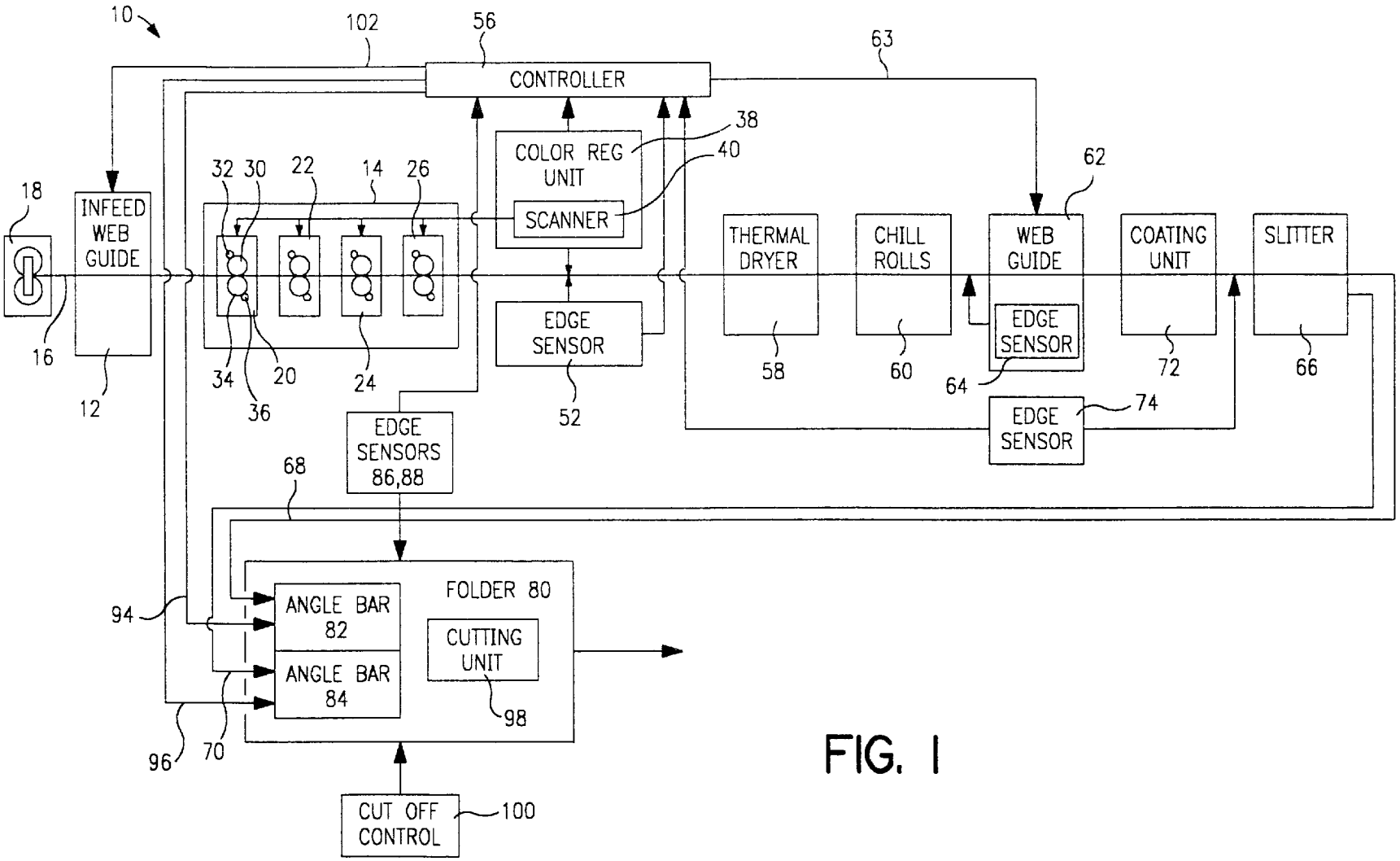
FIG. 1 is a schematic view of a web-fed printing system illustrating a first embodiment of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is a web-fed printing system 10 including an infeed web guide 12 and a printing press 14. A web 16, typically paper, is fed from a reel stand 18 through a web guide 12 to the printing press 14. Printing press 14 comprises a plurality of serially disposed conventional printing units 20, 22, 24, 26. In a web offset printing press, each of the printing units includes an upper blanket cylinder 30, an upper plate cylinder 32, a lower blanket cylinder 34, and a lower plate cylinder 36, as is well known in the art. Printing units 20, 22, 24, 26 cooperate to imprint multi-color images on the upper and lower surfaces of web 16. Each printing unit prints an associated color of ink; typically printing unit 20 prints the color black, and subsequent units 22, 24, 26 print the colors cyan, magenta, and yellow. The invention is not limited in its application to a four color printing process, but may also be used in conjunction with a single color printing process, or a multi-color printing process having any number of printing units.

In order to register (align) the respective images generated by each of the individual printing units, a color registration unit 38 is employed. In the preferred embodiment of the invention, the commercially available RGS V (Register Guidance System V), obtainable from Quad/Tech, Inc. of Sussex, Wis., is used to effect color registration. Color registration unit 38 utilizes an optical line scanner 40 to determine the position of registration marks imprinted on web 16 by each of the individual printing units 20, 22, 24, 26. Typically, one of the ink colors is selected as a reference, and the position of the other ink colors is ascertained relative to the reference ink color. Appropriate control signals are generated to the respective electric motors (not shown) which are coupled to the plate cylinders thereby controlling the lateral and longitudinal position of the plate cylinders as necessary to maintain registration between ink colors.

In conventional operation, color registration unit 38 determines the position of each ink color with respect to a reference ink color. In the preferred embodiment of the present invention, however, color registration unit 38, in conjunction with edge sensor 52, provides data to controller 56, which determines the actual lateral position of the ink on the web as measured from a web edge. Although any type of optical scanner capable of sensing the ink on the web may be used to provide data indicative of the actual lateral position of ink on the web, in the preferred embodiment, optical scanner 40 of color registration unit 38 is employed thereby minimizing the required number of optical scanners in the system.

Figure 2:
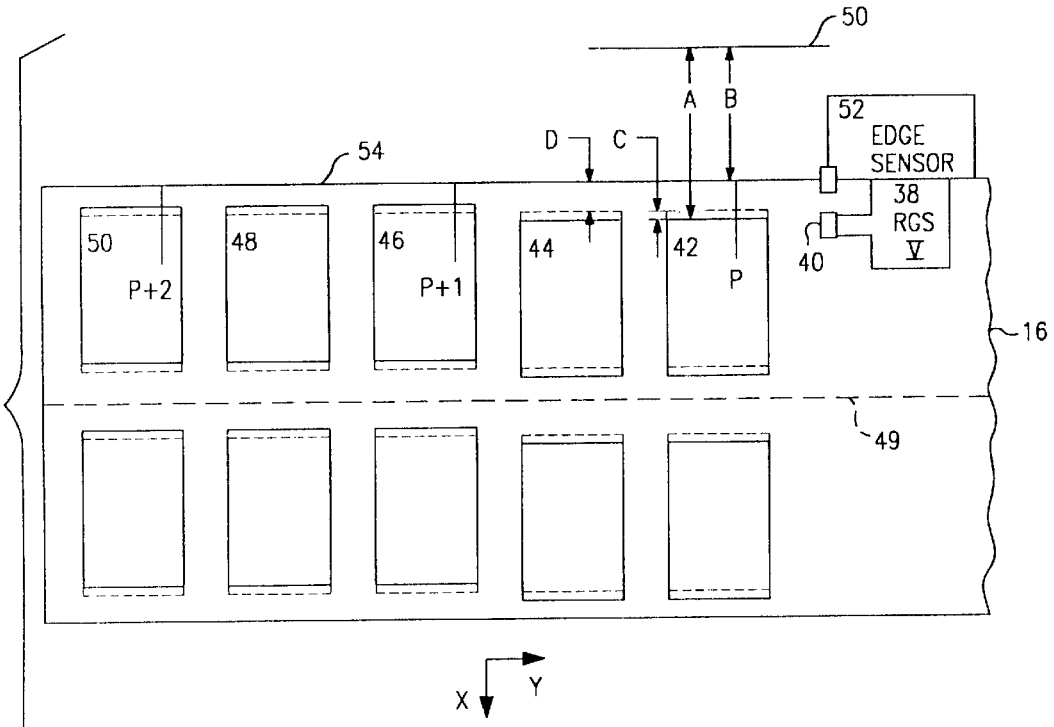
FIG. 2 is a top view of the web illustrating a plurality of images printed thereon.

Referring to FIG. 2, the direction of web motion is illustrated as being in the direction of the positive y axis, and the lateral web direction is along the x axis. Stationary axis 50, best described as any fixed, non-movable reference, is substantially parallel to the direction of web motion.

Multicolor images 42, 44, 46, and 48 are printed on web 16 by printing units 20, 22, 24, 26 and are shown in solid lines. The desired or nominal placement of these images as laterally centered on web 16 is shown in dashed lines. The nominal placement of the image on the web may vary for different press runs. Dashed line 49 indicates the desired or nominal placement of the slit, which may also vary for different press runs. During printing, the actual lateral position of image 42 is shifted from its nominal position due to lateral movement of web 16. Thus, optical scanner 40 determines the actual lateral position of ink relative to stationary axis 50. The distance between the stationary axis 50 and actual lateral ink position of image 42 is depicted as dimension A in FIG. 2. Note that the actual lateral ink position need not be measured from the edge of the image as is illustrated, but may be measured from any appropriate point in the image that is capable of functioning as a lateral reference to optical scanner 40. For example, register marks (not illustrated) commonly printed for use with the color registration unit 38 may be used as an appropriate lateral reference.

Concurrently, edge sensor 52 monitors the position of the edge 54 of web 16. Edge sensor 52 is located laterally across from scanner 40 and determines dimension B relative to the stationary axis 50. In this manner, the placement of the ink on the web as referenced to web edge 54 is determined.

Referring back to FIG. 1, a controller 56 is disposed to communicate with color registration unit 38 and edge sensor 52. A signal indicative of lateral ink dimension A and a signal indicative of lateral web edge dimension B are fed to controller 56. From the two dimensions controller 56 computes an edge-to-ink dimension (A-B). A nominal edge-to-ink dimension, illustrated as dimension D in FIG. 2, is input as a control variable to controller 56. Note that dimension D can be a desired edge-to-ink dimension input to controller 56 by an operator. Alternately, dimension D may be relative and may, for example, be determined by averaging the edge-to-ink position for the first few images printed, and having an operator make adjustments as necessary to align the downstream system components, as is known in the art.

Controller 56 computes the magnitude and direction of offset between the actual and nominal edge-to-ink position, illustrated in FIG. 2 as dimension C [C=(A−B)−D]. Edge sensor 52 and color registration unit 38 provide information to controller 56 for a series of points P, P+1, P+2 on web 16 as web 16 passes underneath scanner 40. Because web 16 is subject to spurious lateral shifts, dimension A and dimension B vary for different sampled points on the web. It is to be understood that the frequency of sampling need not be every other image as is illustrated in FIG. 2. Rather, the frequency of sampling is chosen based on how much lateral shifting of the web occurs in a given time period, the processing capabilities of controller 56, as well as the processing capabilities of color registration unit 38.

Thus, an offset is calculated for each of a series of points (P, P+1, P+2, etc.) on web 16 as those points move past optical scanner 40 and edge sensor 52. The calculated offset (dimension C) for each point is stored by controller 56 along with a time or longitudinal dimension which serves to associate the offset with its longitudinal position on web 16.

Referring back to FIG. 1, web 16 is subsequently routed through a thermal dryer 58, a series of chill rolls 60, and web guide 62. Dryer 58 heats the web 16 to evaporate various solvents in the ink. Chill rolls 60 operate to quickly cool the web after the drying step to set the ink.

Figure 3:
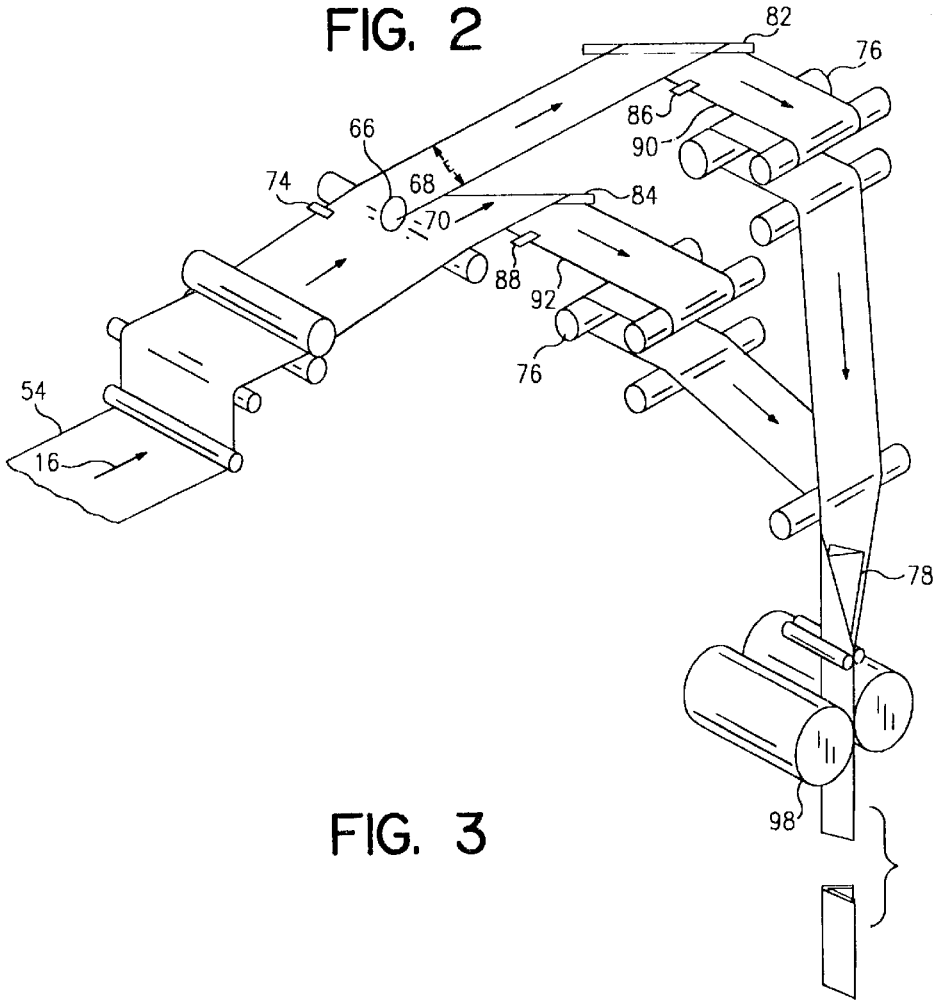
FIG. 3 is a perspective view of the last portion of the web-fed printing system illustrating a first embodiment of the invention.

Web guide 62 operates to laterally position the web fed to slitter 66 and is responsive to a control signal from controller 56 on line 63. Slitter 66 operates to slit web 16 longitudinally (substantially parallel to the direction of web motion) into two ribbons 68, 70 as illustrated in FIG. 3. Slitter 66 is stationary and its position with respect to web guide 62 is known. An edge sensor 64, internal to web guide 62, is nominally positioned with respect to slitter 66. Edge sensor 64 tracks the lateral position of web edge 54 referenced to its nominal position. This occurs for point P and subsequent sampled points on the web. Controller 56 feeds to web guide 62 a control signal on line 63 representative of the offset (dimension C) measured for point P and subsequent sampled points on the web. Web guide 62 moves the web laterally based on the received control signal as well as the actual lateral edge position as measured by edge sensor 64. Appropriate timing signals are maintained within controller 56 so that the appropriate control signal corresponding to point P is fed to web guide 62 at the appropriate time, i.e., when point P has reached web guide 62. Because the offset is the lateral dimension between actual and nominal edge-to-ink position, web 16 is laterally moved by that amount from its nominal position with respect to slitter 66 in order for slitter 66 to slit web 16 relative to the actual position of ink on the web.

In the preferred embodiment, a coating unit 72 which applies a silicone coating to web 16 is located between web guide 62 and slitter 66. While it would be most advantageous to have web guide 62 located directly adjacent slitter 66, in some process lines this is not possible. In order to effect secondary loop control, an additional edge sensor 74 is located at slitter 66, and monitors web edge 54, the same web edge monitored upstream by edge sensor 52. Edge sensor 74 provides information useful for two purposes. First, edge sensor 74 provides an indirect feedback loop via controller 56 to web guide 62 in order to adjust for any systematic lateral movement of the web occurring between web guide 62 and slitter 66, which lateral movement can be accounted for by correcting the control signal fed via line 63 to web guide 62. Second, because the position of edge sensor 74 is constant and known relative to slitter 66, edge sensor 74 provides to controller 56 information which controller 56 processes to determine a dimension E (shown in FIG. 3) which is representative of the lateral distance between the outside web edge 54 and the slit edge of ribbon 68. Dimension E thus provides a measure of the lateral position of the actual slit as referenced to web edge 54.

Referring to FIGS. 1 and 3, after exiting slitter 66, ribbons 68 and 70 are aligned one on top of the other. The stacked ribbons are then fed to the former board 78 of a folder 80 which operates to fold ribbons 68 and 70 longitudinally. Folder 80 includes various positioning mechanisms such as angle bars, idler rollers, and compensators, as is well known in the art. For example, angle bars operate to change the direction of motion of a web or ribbon by approximately ninety degrees, and in so doing, achieve positioning of the web or ribbon in the lateral direction. The movement of compensators 76 allows the ribbons to be positioned in the longitudinal direction as well.

Ribbons 68 and 70 are aligned laterally with respect to former board 78 such that the ribbons are folded relative to the actual position of ink on the web. To achieve this, the lateral position of ribbon 68 is monitored by edge sensor 86 positioned at angle bar 82 to sense the position of ribbon edge 90. Ribbon edge 90 corresponds to web edge 54 scanned by edge sensor 52 upstream. Similarly, the lateral position of ribbon 70 is monitored by edge sensor 88 positioned at angle bar 84 to sense the position of ribbon edge 92, which is the slit edge of ribbon 70. Signals from edge sensor 86 and edge sensor 88 are communicated to controller 56. Angle bars 82 and 84 are responsive to control signals from controller 56 on lines 94 and 96 to laterally position ribbons 68 and 70 respectively.

More specifically, controller 56 computes the control signal on line 94 to control the lateral positioning of ribbon 68 for a series of points, P, P+1, P+2, etc., as these points respectively reach angle bar 82, taking into account information regarding the actual position of the image on the web (measured with respect to the edge) as displaced from its nominal position (dimension C) for each point, as well as information from edge sensor 86 regarding the lateral position of the corresponding point of the ribbon with respect to the former board 78. Angle bar 82 is responsive to the control signal on line 94 and adjusts the lateral position of ribbon 68 so that the fold is displaced from its nominal position when the actual position of ink on the web is displaced from its nominal position.

Similar to the positioning of web 16 with respect to slitter 66 as previously described, appropriate timing signals are maintained within controller 56 so that the offset dimension corresponding to point P is fed to the respective angle bar 82 at the appropriate time, i.e., approximately when point P has reached the angle bar 82, and similarly for subsequent sampled points.

Similarly, controller 56 provides a second control signal on line 96 to move angle bar 84 to laterally align ribbon 70 with former board 78. Controller 56 computes this control signal similar to the control signal on line 94, as described above. It is also possible, however, in computing the second control signal, to take into account information regarding the position of the actual slit based on the information provided by edge sensor 74 as previously described (dimension E). In this manner, an edge-to-ink dimension is determined for ribbon 70 based on the actual slit position, and thus more accurate positioning of ribbon 70 with respect to the former board 78 of folder 80 is possible.

The laterally aligned ribbons are then fed to the former board 78 of folder 80, which operates to fold the ribbons longitudinally. Folder 80 also includes a cutting unit 98 which severs ribbons 68 and 70 transversely. Cutoff control is achieved with a cutoff control unit 100 such as the commercially available PPC 3000, also obtainable from Quad/Tech, Inc. of Sussex, Wis. The PPC 3000 provides control of web compensators 76 in FIG. 3 and other correction devices (not shown) to maintain the longitudinal position of the printed image in relation to the cutting blade (not shown) of cutting unit 98 to obtain cutoff at the proper image repeat position.

In the preferred embodiment of the system, infeed web guide 12 is also responsive to a control signal on line 102 from the controller 56. The control signal on line 102 is a feedback signal containing information indicative of the systematic lateral offset between actual edge-to-ink position and desired edge-to-ink position. Infeed web guide 12 automatically adjusts the lateral position of web 16 relative to the printing press 14 based on the feedback signal so as to minimize the offset.

The positions of the scanner of the infeed web guide 12, scanner 40, scanner 74, edge sensors 52, 64, 86, 88, slitter 66, and former board 78 may be set at start-up based upon the specific end product desired from the image to be printed as well as the desired location of that image on the web. In other words, because the desired edge-to-ink dimension is known for a given image, as are the desired edge-to-slit and edge-to-fold dimensions, the nominal positions of the various components mentioned above can be positioned relative to one another. For example, the position of the scanner of the infeed web guide 12 relative to the plate cylinders of the printing unit 20 may be set. Also, the position of the edge sensor 52 and scanner 40 may be set relative to the plate cylinders of printing unit 20. Similarly, the position of edge sensor 64 relative to slitter 66 can be set, and the position of edge sensors 86 and 88 relative to the former board 78 can be set.

The embodiment of the invention as described therefore operates to effect slitting and folding relative to the actual position of ink on the web as well as operating so as to minimize the offset between actual and desired edge-to-ink positions. Various other printing process setups are possible and it is to be understood that a printing system 10 that includes a folder 80 without a slitter 66, or includes a slitter 66 without a folder 80 may also use the principles of the invention to improve printed product quality.

Figure 4:
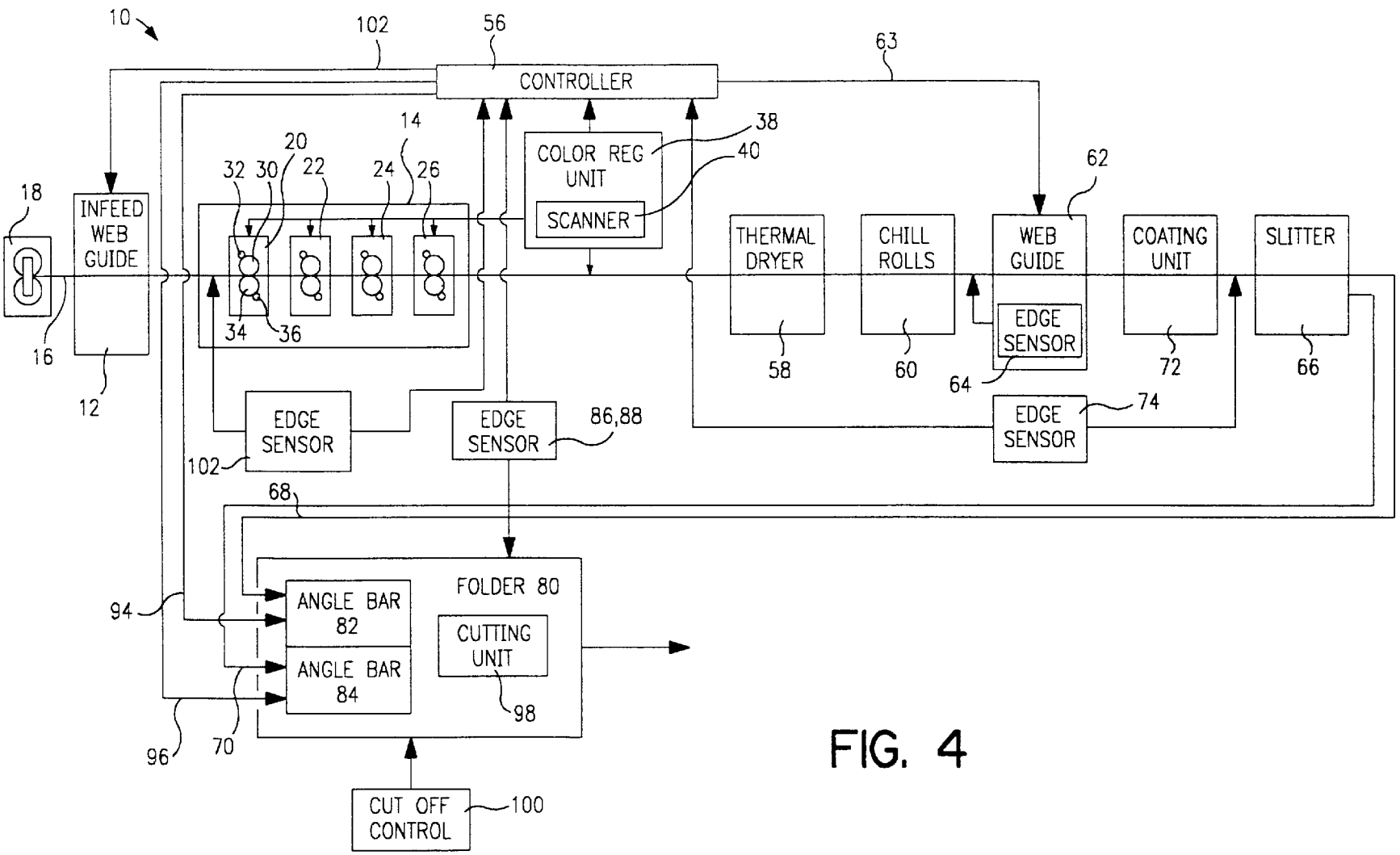
FIG. 4 is a schematic view of a web-fed printing system illustrating a second embodiment of the invention.

FIG. 4 illustrates an alternative means for determining the actual lateral position of the ink as measured from a web edge, wherein like parts are designated with like reference numerals. In FIG. 4, color registration unit 38 operates to control the position of printing plate cylinders 32 for three of the printing units 22, 24, 26 in relation to the position of printing plate cylinder 32 for a fourth, or reference printing unit 20, which typically remains stationary. Here, color registration unit 38 operates in its standard registration mode and does not function to ascertain the position of the ink relative to a stationary axis as described in the previous embodiment. Instead, by monitoring web edge 54 at a point immediately preceding the printing units, the actual lateral position of the ink on the web with respect to an edge may be determined. More specifically, this is accomplished by edge sensor 104 disposed near reference printing unit 20. Edge sensor 104 communicates with controller 56. Because the lateral position of edge sensor 104 relative to plate cylinder 32 of printing unit 20 is known, and only an insignificant amount of web shifting can occur between edge sensor 104 and plate cylinder 32, the signal from edge sensor 104 to controller 56 is an accurate indication of the actual lateral position of the ink on the web as measured from web edge 54.

If it is necessary to move the plate cylinder of reference printing unit 20 during the color registration process, the amount of lateral movement required can be communicated to controller 56. In this manner, controller 56 can calculate the actual edge-to-ink dimension for a series of points on web 16, taking into account any movement of the plate cylinder of reference printing unit 20.

Figure 5:
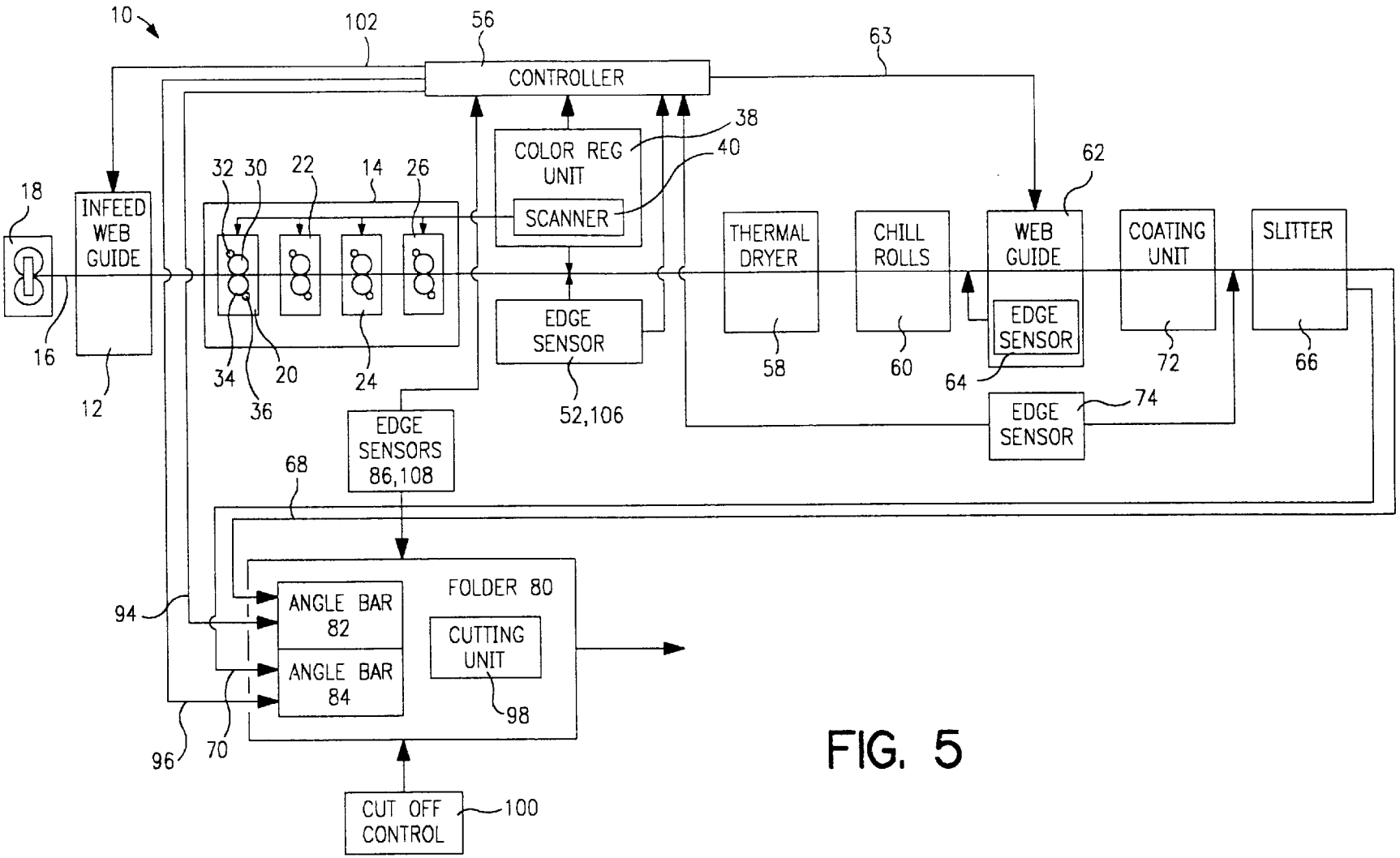
FIG. 5 is a schematic view of a web-fed printing system illustrating a third embodiment of the invention.
Figure 6:
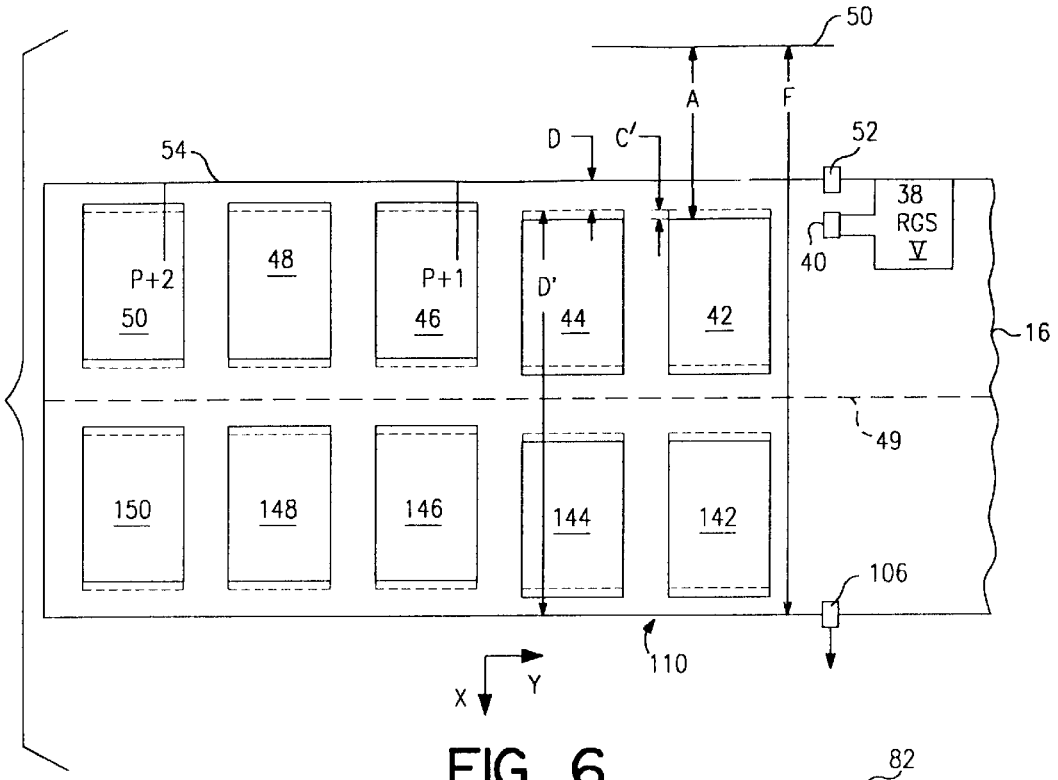
FIG. 6 is a top view of the web illustrating a plurality of images printed thereon.
Figure 7:
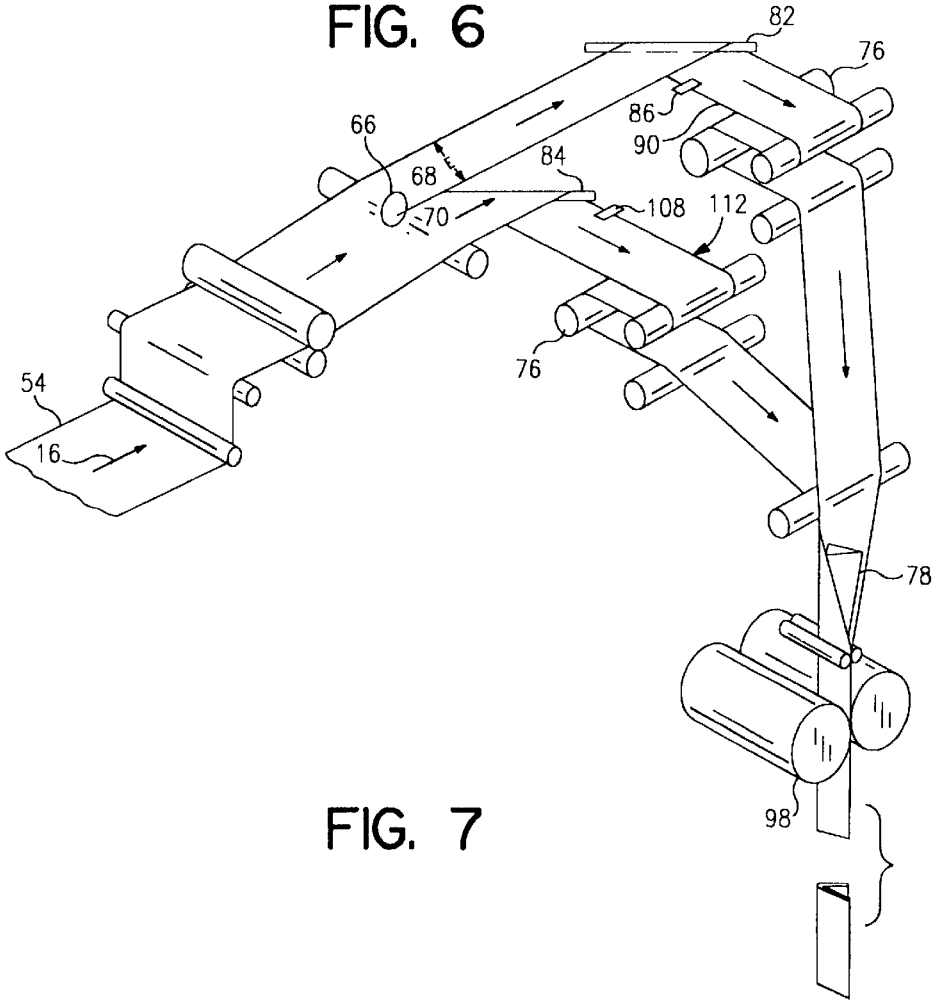
FIG. 7 is a perspective view of the last portion of the web-fed printing system illustrating a third embodiment of the invention.

Another embodiment of the invention is illustrated in FIGS. 5–7 wherein an additional edge sensor 106 is utilized to monitor web edge 110, which is the web edge opposite web edge 54. Multicolor images 42, 44, 46, and 48 are printed on web 16 by printing units 20, 22, 24, 26 and are shown in solid lines. The desired or nominal placement of these images is shown in dashed lines. The actual lateral position of image 42 is shifted from its nominal position due to lateral movement of web 16. Thus, optical scanner 40 determines the actual lateral position of ink relative to stationary axis 50. The distance between the stationary axis 50 and actual lateral ink position of image 42 is depicted as dimension A in FIG. 6.

Concurrently, edge sensor 52 monitors the position of the edge 54 of web 16. Edge sensor 52 is located laterally across from scanner 40 and determines dimension B relative to the stationary axis 50. Additionally, edge sensor 106, also located laterally across from scanner 40, monitors the position of web edge 110. Edge sensor 106 determines dimension F relative to axis 50. In this manner, the placement of the ink on the web as referenced to web edge 54, as well as web edge 110, is determined.

Edge sensors 52, 106 communicate with controller 56. A signal indicative of lateral ink dimension A as well as a signal indicative of lateral web edge dimensions B and F are measured and fed to controller 56. From the three dimensions controller 56 computes a first edge-to-ink dimension (A-B) as measured from edge 54 as well as a second edge-to-ink dimension (F-A) as measured from edge 110. A nominal first edge-to-ink dimension, illustrated as dimension D in FIG. 6, is input as a control variable to controller 56. Additionally, a nominal second edge-to-ink dimension, illustrated as D', is input to controller 56. Controller 56 computes the magnitude and direction of offset between the actual and nominal edge-to-ink position for both web edges. For web edge 54, as illustrated in FIG. 2, controller 56 computes dimension C [C=(A−B)−D]. Additionally, for web edge 110, as illustrated in FIG. 6, controller 56 computes C' [C'=D'−(F−A)].

Edge sensors 52, 106 and color registration unit 38 provide information to controller 56 for a series of points P, P+1, P+2 on web 16 as web 16 passes underneath scanner 40. Because web 16 is subject to spurious lateral shifts, dimensions A, F and B vary for different sampled points on the web.

Thus, an offset is calculated for each of a series of points (P, P+1, P+2, etc.) on web 16 as those points move past optical scanner 40 and edge sensors 52 and 106. The calculated offsets (dimensions C and C') for each point are stored by controller 56 along with a time or longitudinal dimension which serves to associate the offset with its longitudinal position on web 16.

Web guide 62 operates to laterally position the web fed to slitter 66 and is responsive to a first control signal from controller 56 on line 63. Slitter 66 operates to slit web 16 longitudinally (substantially parallel to the direction of web motion) into two ribbons 68, 70 as illustrated in FIG. 7. Slitter 66 is stationary and its position with respect to web guide 62 is known. An edge sensor 64, internal to web guide 62, tracks the lateral position of web edge 54 referenced to its nominal position with respect to slitter 66 for point P and subsequent sampled points on the web. Controller 56 feeds to web guide 62 a first control signal on line 63 representative of the offset (dimension C) measured for point P and subsequent sampled points on the web. Web guide 62 moves the web laterally based on the first control signal received as well as the actual lateral edge position as measured by edge sensor 64. Appropriate timing signals are maintained within controller 56 so that the control signal corresponding to point P is fed to web guide 62 at the appropriate time, i.e., when point P has reached web guide 62. Because the offset is the lateral dimension between actual and nominal edge-to-ink position, web 16 is laterally moved by that amount from its nominal position with respect to slitter 66 in order for slitter 66 to slit web 16 relative to the actual position of ink on the web.

Referring to FIGS. 5 and 7, after exiting slitter 66, ribbons 68 and 70 are aligned one on top of the other. The stacked ribbons are then fed to the former board 78 of a folder 80 which operates to fold ribbons 68 and 70 longitudinally.

Ribbons 68 and 70 are aligned laterally with respect to former board 78 such that the ribbons are folded relative to the actual position of ink on the web. To achieve this, the lateral position of ribbon 68 is monitored by edge sensor 86 positioned at angle bar 82 to sense the position of ribbon edge 90. Ribbon edge 90 corresponds to web edge 54 scanned by edge sensor 52 upstream. Similarly, the lateral position of ribbon 70 is monitored by edge sensor 108 positioned at angle bar 84 to sense the position of ribbon edge 112, which corresponds to upstream web edge 110. Signals from edge sensor 86 and edge sensor 108 are communicated to controller 56. Angle bars 82 and 84 are responsive to control signals from controller 56 on lines 94 and 96 to laterally position ribbons 68 and 70 respectively.

More specifically, controller 56 computes a second control signal to control the lateral positioning of ribbon 68 for a series of points, P, P+1, P+2, etc., as these points respectively reach angle bar 82. The second control signal takes into account information regarding the actual edge-to-ink position of the image on the web, as displaced from its nominal position, as well as information from edge sensor 86. Angle bar 82 is responsive to the second control signal on line 94 and adjusts the lateral position of ribbon 68 so that ribbon 68 is folded with respect to the actual position of ink on the ribbon.

Similarly, controller 56 provides a third control signal on line 96 to move angle bar 84 to laterally align ribbon 70 with former board 78 thereby controlling the lateral positioning of ribbon 70 for a series of points, P, P+1, P+2, etc., as these points respectively reach angle bar 84. The third control signal takes into account information regarding the actual edge-to-ink position of the image on the web (referring to edge 110), as displaced from its nominal position, as well as information from edge sensor 108. Angle bar 84 is responsive to the third control signal on line 96 and adjusts the lateral position of ribbon 70 so that the ribbon 70 is folded with respect to the actual position of ink on the ribbon.

The laterally aligned ribbons 68, 70 are then fed to former board 78 which operates to fold the ribbons longitudinally. Folder 80 also includes a cutting unit 98 which severs ribbons 68 and 70 transversely.

It is also contemplated that the invention pertain to various printing system setups including ones in which a plurality of slitters are employed to longitudinally slit the web into more than two ribbons.

It is also contemplated that the invention be applicable to processes which include various other processing units such as perforation units, punching units, numbering units, gluing units, or tabbing units, where the lateral position of the web with respect to the processing unit is important.

It is recognized that various equivalents, alternatives and modifications are possible within the scope of the appended claims.

We claim:

1. A method for controlling the lateral position of a travelling web in a web-fed printing press, the web travelling in a longitudinal direction and having a series of printed images thereon, the method comprising the steps of:

determining the lateral position of an image on the web with respect to a web edge for a series of selected images as the selected images pass a first point;

storing the lateral position along with data indicative of the longitudinal position of the image on the web for each selected image;

calculating a control signal based on the lateral position for each selected image; and using the data indicative of the longitudinal position to provide the control signal at the appropriate time to a web positioning device responsive thereto and located downstream of the first point to laterally position the web to generally maintain a predetermined lateral distance between each selected image and a web processing device.

2. The method of claim 1 wherein the step of determining the lateral position of an image on the web with respect to a web edge includes using an edge sensor located adjacent a printing unit and at a predetermined distance therefrom.

3. The method of claim 1 wherein the step of determining the lateral position of an image on the web with respect to a web edge includes sensing the lateral position of the web edge corresponding to a portion of the image with respect to a reference axis and sensing the lateral position of the portion of the image with respect to the reference axis.

4. The method of claim 3 wherein the image includes register marks and the step of sensing the lateral position of the portion of the image includes using an optical sensor for sensing the lateral position of the register marks.

5. The method of claim 3 wherein the step of sensing the lateral position of the web edge includes using an edge sensor.

6. The method of claim 1 wherein the web positioning device is a web guide, the web processing device is a slitter and wherein the web guide laterally positions the web relative to the slitter.

7. The method of claim 6 further including the step of using an edge sensor to provide edge data indicative of the lateral position of the web edge at the web guide and wherein the web guide is responsive to the edge data.

8. The method of claim 6 further including the step of providing the control signal to an angle bar responsive thereto and located downstream of the slitter, wherein the angle bar laterally positions the web to generally maintain a predetermined lateral distance between each selected image and a folder.

9. The method of claim 8 further including the step of using a second edge sensor to provide second edge data indicative of the lateral position of a web edge at the angle bar and wherein the angle bar is responsive to the second edge data.

10. The method of claim 1 wherein the web positioning device includes an angle bar, the web processing device includes a folder, and wherein the angle bar laterally positions the web relative to the folder.

11. The method of claim 10 further including the step of using an edge sensor to provide edge data indicative of the lateral position of the web at the angle bar and wherein the angle bar is responsive to the edge data.

12. A system for controlling the lateral position of a travelling web in a web-fed printing press, the web travelling in a longitudinal direction and having a series of printed images thereon, the system comprising:

means for sensing the lateral position of an image on the web with respect to a web edge for a series of selected images;

means for determining the longitudinal position of each of the selected images;

a controller including memory for storing the lateral position along with the corresponding longitudinal position of each of the selected images, the controller operable to calculate a control signal based on the lateral position and longitudinal position for each selected image; and a web positioning device located downstream of the means for sensing and responsive to the control signal for laterally positioning the web to generally maintain a predetermined lateral distance between each selected image and a web processing device.

13. The system of claim 12 wherein the sensing means includes an optical scanner for sensing the lateral position of a portion of the image and an edge sensor for sensing the corresponding web edge.

14. The system of claim 13 wherein the image includes register marks and the optical scanner senses the register marks.

15. The system of claim 12 further including at least one printing unit for printing the series of printed images and wherein the sensing means includes an edge sensor disposed a predetermined lateral distance from the printing unit.

16. The system of claim 12 wherein the web positioning device is a web guide, and the web guide positions the web relative to a slitter.

17. The system of claim 16 further including an edge sensor to produce edge information at the web guide and wherein the web guide is responsive to the edge information.

18. The system of claim 16 further including an angle bar located downstream of the web guide and responsive to the control signal to laterally position the web to generally maintain a predetermined lateral distance between each selected image and a folder.

19. The system of claim 18 and further including a second edge sensor to produce second edge information at the angle bar and wherein the angle bar is responsive to the second edge data.

20. The system of claim 12 wherein the web positioning device includes an angle bar and wherein the angle bar laterally positions the web relative to a folder.

21. The system of claim 20 further including an edge sensor producing edge information at the angle bar and wherein the angle bar is responsive to the edge information.

* * * * *